US010119736B2

(12) United States Patent
Nagafuji

(10) Patent No.: US 10,119,736 B2
(45) Date of Patent: Nov. 6, 2018

(54) CONDENSER

(71) Applicant: KEIHIN THERMAL TECHNOLOGY CORPORATION, Oyama-shi (JP)

(72) Inventor: Teruyuki Nagafuji, Oyama (JP)

(73) Assignee: KEIHEN THERMAL TECHNOLOGY CORPORATION, Oyama-Shi (JP)

( * ) Notice: Subject to any disclaimer, the term of this patent is extended or adjusted under 35 U.S.C. 154(b) by 0 days.

(21) Appl. No.: 15/790,055

(22) Filed: Oct. 23, 2017

(65) Prior Publication Data

US 2018/0135904 A1 May 17, 2018

(30) Foreign Application Priority Data

Nov. 15, 2016 (JP) ..... 2016-222231

(51) Int. Cl.
*F25B 43/02* (2006.01)
*F25B 39/04* (2006.01)
*F25B 40/02* (2006.01)

(52) U.S. Cl.
CPC ..... *F25B 43/02* (2013.01); *F25B 39/04* (2013.01); *F25B 40/02* (2013.01); *F25B 2339/0441* (2013.01)

(58) Field of Classification Search
CPC ..... F25B 43/02; F25B 39/04; F25B 40/02; F25B 2339/0441
USPC ..... 165/160
See application file for complete search history.

(56) References Cited

U.S. PATENT DOCUMENTS 7,165,417 B2 * 1/2007 Operschall ..... F25B 39/04 62/474
7,213,412 B2 * 5/2007 Kent ..... F25B 39/04 62/509
2008/0115528 A1 * 5/2008 Yamamoto ..... B60H 1/3227 62/513
2013/0206378 A1 * 8/2013 Kent ..... F25B 39/04 165/173

FOREIGN PATENT DOCUMENTS

JP 4743802 B2 8/2008

* cited by examiner

*Primary Examiner* — Jianying Atkisson
*Assistant Examiner* — Joel Attey
(74) *Attorney, Agent, or Firm* — Mori & Ward, LLP

(57) ABSTRACT

A condenser includes a condensation section, a super-cooling section located above the condensation section, and a liquid receiver. The liquid receiver has a first space communicating with the condensation section through a refrigerant inlet and a second space located above the first space and communicating with the super-cooling section through a refrigerant outlet. A suction pipe which is open at upper and lower ends thereof and which establishes communication between the first space and the second space is disposed in the first space. A tubular flow control member whose upper end is open is disposed around the suction pipe such that the refrigerant having flowed into the first space through the refrigerant inlet hits against the flow control member and changes its flow direction. Since the refrigerant inlet is located within the vertical range of the flow control member, the refrigerant hits against the flow control member.

6 Claims, 5 Drawing Sheets

CONDENSER

BACKGROUND OF THE INVENTION

The present invention relates to a condenser used in a refrigeration cycle which constitutes, for example, a car air conditioner.

Herein and in the appended claims, the upper side, lower side, left-hand side, and right-hand side of FIGS. 1 and 2 will be referred to as "upper," "lower," "left," and "right," respectively.

Also, herein, the term "liquid-phase refrigerant" encompasses liquid-phase predominant mixed-phase refrigerant containing a small amount of gas-phase refrigerant.

There has been known a condenser of a refrigeration cycle which constitutes a car air conditioner (see Japanese Patent No. 4743802). The known condenser includes a condensation section, a super-cooling section provided above the condensation section, and a liquid receiver provided between the condensation section and the super-cooling section. Each of the condensation section and the super-cooling section has one heat exchange path formed by a plurality of heat exchange tubes disposed parallel to one another such that their longitudinal direction coincides with the left-right direction and they are spaced from one another in the vertical direction. Refrigerant flowing out of the condensation section flows into the super-cooling section through the liquid receiver. The liquid receiver has a refrigerant inlet which is located at the vertically central portion of the condensation heat exchange path of the condensation section and through which the refrigerant from the heat exchange path flows into the liquid receiver, and a refrigerant outlet which is located above the refrigerant inlet and through which the refrigerant flows out to the super-cooling heat exchange path of the super-cooling section. A partition member (horizontal plate) is disposed in the liquid receiver at a vertical position between the condensation section and the super-cooling section so as to divide the interior space of the liquid receiver into a first space communicating with the condensation section through the refrigerant inlet, and a second space located above the first space and communicating with the super-cooling section through the refrigerant outlet. A suction pipe which is open at upper and lower ends thereof and establishes communication between the first space and the second space is disposed in the first space of the liquid receiver. The interior space of the suction pipe communicates with the second space through a communication opening in the form of a through hole provided in the partition member.

In the condenser described in the above-described publication, the refrigerant having passed through the condensation section flows into the first space within the liquid receive though the refrigerant inlet, and is separated into gas-phase refrigerant and liquid-phase refrigerant. The liquid-phase refrigerant flows into the second space through the suction pipe, and then flows into the super-cooling section through the refrigerant outlet.

However, the condenser described in the above-described publication has the following problem. Since the refrigerant inlet is located at the vertically central portion of the condensation heat exchange path of the condensation section, during operation of a car air conditioner, liquefaction of refrigerant proceeds and liquid-phase refrigerant stagnates in at least some of the heat exchange tubes of the condensation section heat exchange path, which heat exchange tubes are located below the refrigerant inlet. As a result, it becomes impossible to effectively utilize the entire condensation section for heat exchange, and condensation efficiency deteriorates. Further, since a large amount of working oil for a compressor of the car air conditioner (hereinafter referred to as "compressor oil") mixes into the liquid-phase refrigerant stagnating in the condensation section, the circulation of the compressor oil becomes poor.

An effective measure for solving such a problem is to shift the position of the refrigerant inlet to a lower position. However, in such a case, most of the gas-phase refrigerant which is a portion of the gas-liquid mixed-phase refrigerant having flowed from the condensation section into the first space of the liquid receiver through the refrigerant inlet enters the suction pipe along with the liquid-phase refrigerant. As a result, the gas-liquid separation effect at the first space within the liquid receiver is impaired.

SUMMARY OF THE INVENTION

An object of the present invention is to solve the above-described problem and provide a condenser which can enhance the gas-liquid separation performance of the liquid receiver while preventing deterioration of condensation efficiency.

A condenser according to the present invention comprises a condensation section, a super-cooling section provided above the condensation section, and a liquid receiver provided between the condensation section and the super-cooling section. Each of the condensation section and the super-cooling section has at least one heat exchange path formed by a plurality of heat exchange tubes disposed parallel to one another such that their longitudinal direction coincides with a left-right direction and they are spaced from one another in a vertical direction. Refrigerant flowing out of the condensation section flows into the super-cooling section through the liquid receiver. The liquid receiver has a refrigerant inlet through which the refrigerant from the condensation section flows into the liquid receiver, and a refrigerant outlet which is located above the refrigerant inlet and through which the refrigerant flows out to the super-cooling section. The liquid receiver has a first space communicating with the condensation section through the refrigerant inlet, and a second space located above the first space, separated from the first space, and communicating with the super-cooling section through the refrigerant outlet. The condenser comprises a suction pipe which is disposed in the first space of the liquid receive and is open at upper and lower ends thereof, whose opening at the upper end communicates with the second space, and whose opening at the lower end communicates with the first space. The condenser further comprises a flow control member which is disposed in the first space of the liquid receiver and against which the refrigerant having flowed into the first space through the refrigerant inlet hits so that the refrigerant changes its flow direction. A lower end of the suction pipe is disposed below an upper end of the flow control member.

DESCRIPTION OF THE PREFERRED EMBODIMENT

An embodiment of the present invention will next be described with reference to the drawings.

Figure 1:
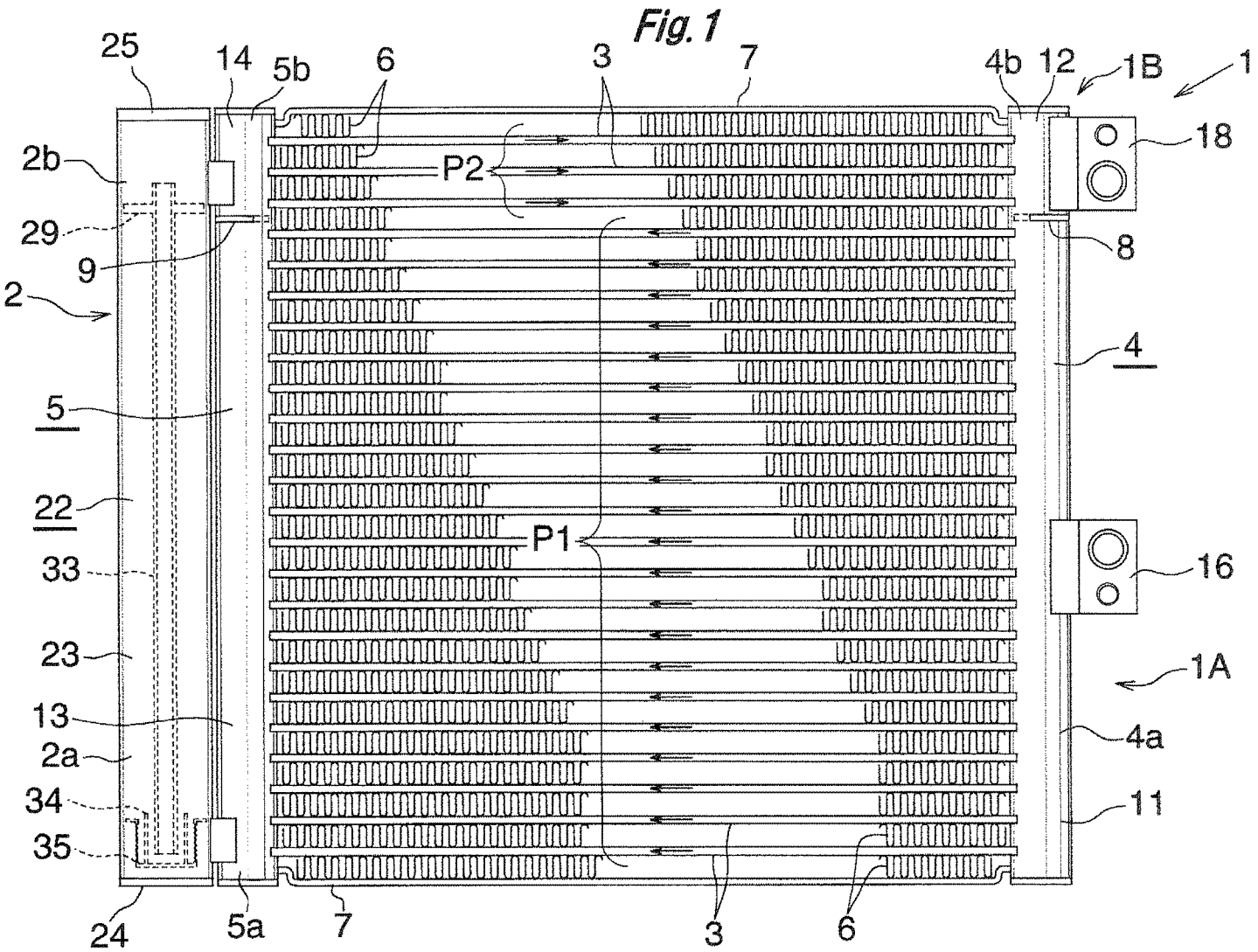
FIG. 1 is a front view showing the overall structure of a condenser according to the present invention.

In the following description, a direction perpendicular to the sheet on which FIG. 1 is drawn will be referred to as an "air-passing direction."

The term "aluminum" as used in the following description encompasses aluminum alloys in addition to pure aluminum.

Figure 2:
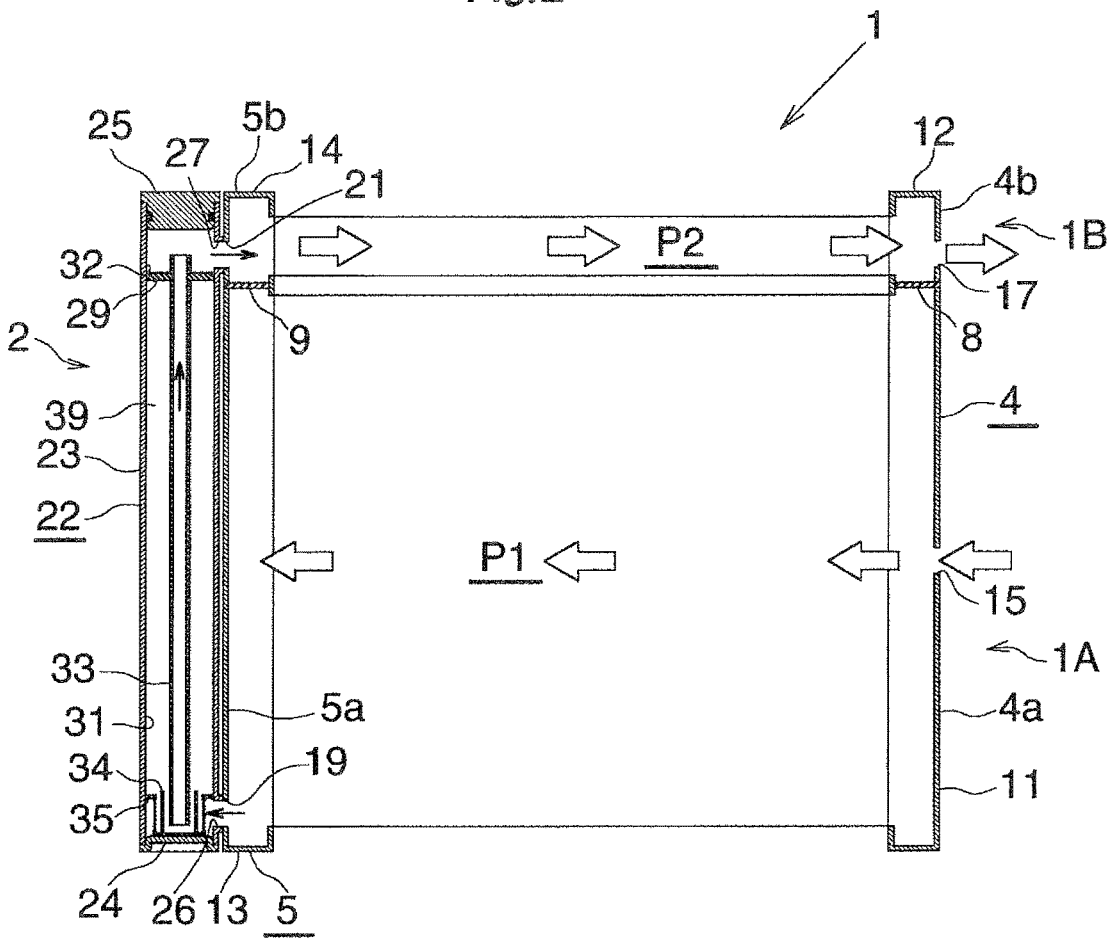
FIG. 2 is a front view schematically showing the condenser of FIG. 1.
Figure 3:
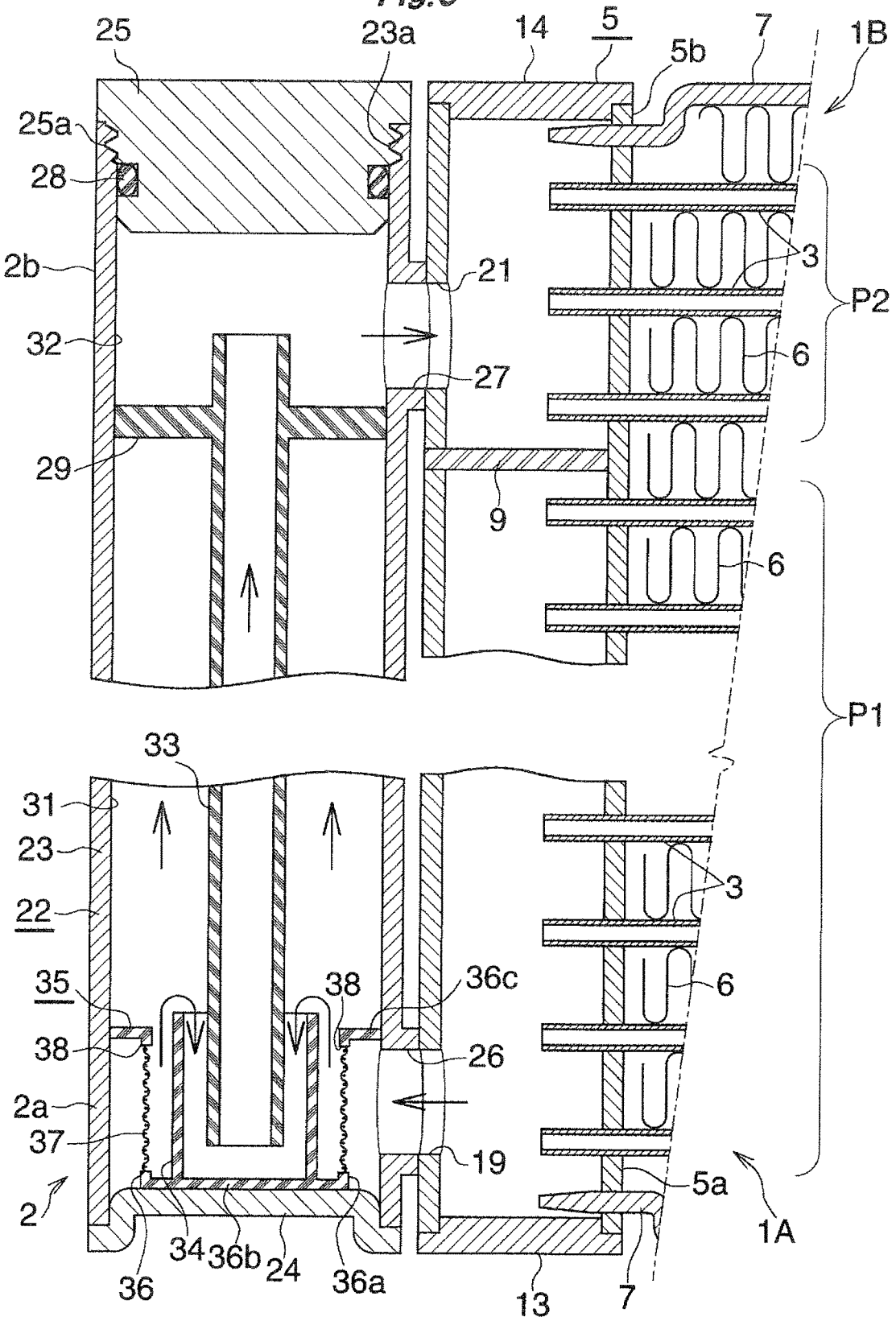
FIG. 3 is a vertical sectional view showing, on an enlarged scale, a main portion of the condenser of FIG. 1, with an intermediate portion of the condenser omitted.
Figure 4:
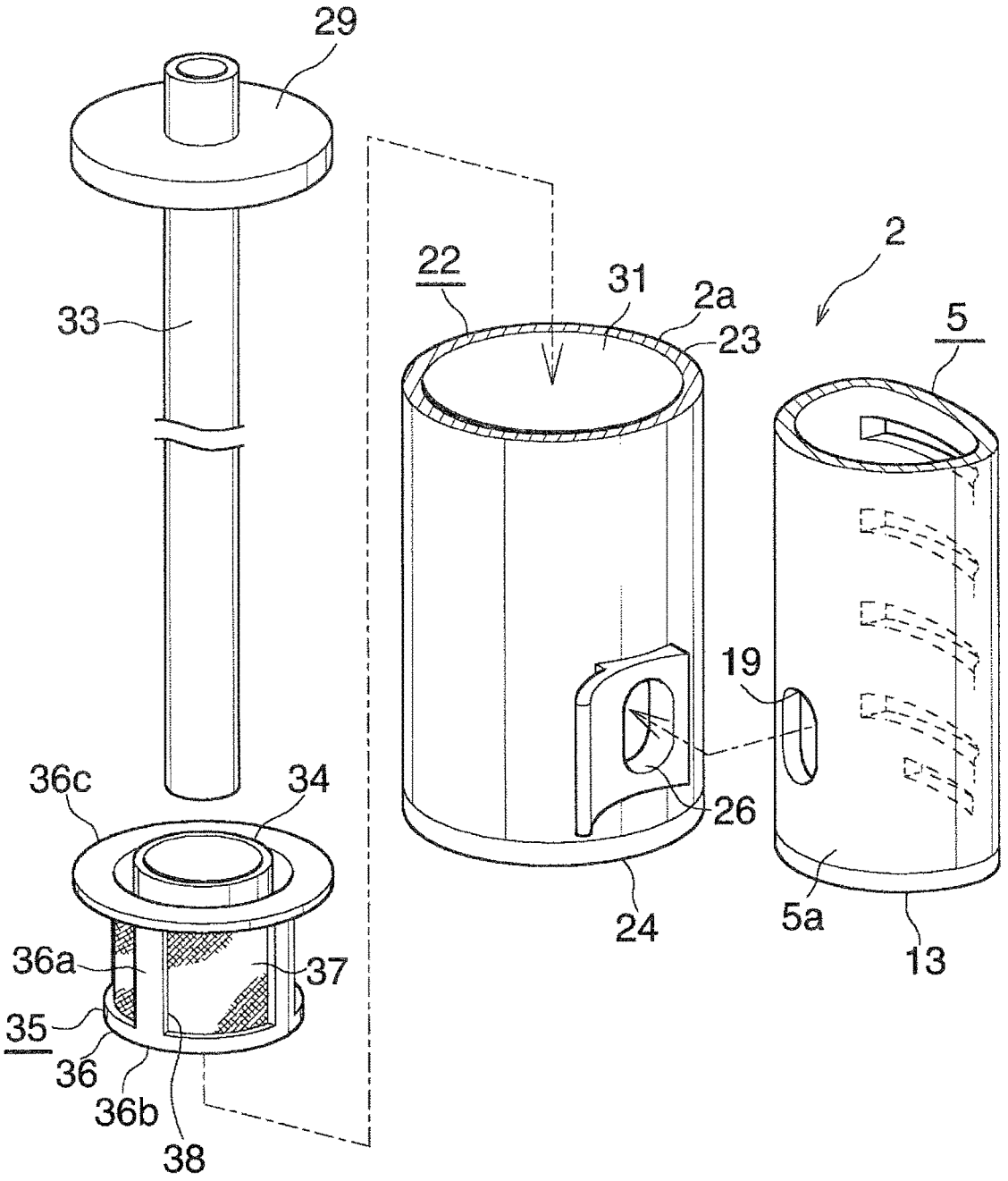
FIG. 4 is an exploded perspective view showing, on an enlarged scale, a lower portion of a liquid receiver of the condenser of FIG. 1, and a partition member, a suction pipe, and a foreign substance removal member which are disposed in the liquid receiver.

FIG. 1 specifically shows the overall structure of a condenser according to the present invention. FIG. 2 schematically shows the condenser of FIG. 1 in which illustration of some members is omitted. FIGS. 3 and 4 show the structure of a main portion of the condenser of FIG. 1.

As shown in FIGS. 1 and 2, a condenser 1 includes a condensation section 1A; a super-cooling section 1B provided above the condensation section 1A; and a tank-like liquid receiver 2 provided between the condensation section 1A and the super-cooling section 1B such that the longitudinal direction of the liquid receiver 2 coincides with the vertical direction. The liquid receiver 2 has a gas-liquid separation function.

The condenser 1 includes a plurality of flat heat exchange tubes 3 formed of aluminum, two header tanks 4 and 5 formed of aluminum, corrugate fins 6 formed of aluminum, and side plates 7 formed of aluminum. The heat exchange tubes 3 are disposed such that their width direction coincides with the air-passing direction, their longitudinal direction coincides with the left-right direction, and they are spaced from one another in the vertical direction. The header tanks 4 and 5 are disposed such that their longitudinal direction coincides with the vertical direction and they are spaced from each other in the left-right direction, and opposite longitudinal end portions of the heat exchange tubes 3 are joined to the header tanks 4 and 5 through use of a brazing material. Each of the corrugate fins 6 is disposed between and joined to adjacent heat exchange tubes 3 through use of a brazing material, or is disposed on the outer side of the uppermost or lowermost heat exchange tube 3 and joined to the corresponding heat exchange tube 3 through use of a brazing material. The side plates 7 are disposed on the corresponding outer sides of the uppermost and lowermost corrugate fins 6, and are joined to these corrugate fins 6 through use of a brazing material. In the following description, joining through use of a brazing material will also be referred to as "brazing."

The condensation section 1A of the condenser 1 includes at least one heat exchange path (in the present embodiment, one heat exchange path P1) formed by a plurality of heat exchange tubes 3 successively arranged in the vertical direction. The super-cooling section 1B of the condenser 1 includes at least one heat exchange path (in the present embodiment, one heat exchange path P2) formed by a plurality of heat exchange tubes 3 successively arranged in the vertical direction. The flow direction of refrigerant is the same among all the heat exchange tubes 3 which form each heat exchange path P1, P2. The flow direction of refrigerant in the heat exchange tubes 3 which form a certain heat exchange path is opposite the flow direction of refrigerant in the heat exchange tubes 3 which form another heat exchange path adjacent to the certain heat exchange path. The heat exchange path P1 of the condensation section 1A will be referred to as the first heat exchange path, and the heat exchange path P2 of the super-cooling section 1B will be referred to as the second heat exchange path.

The header tank 4 has a partition member 8 which is formed of aluminum and is provided at a vertical position between the first heat exchange path P1 and the second heat exchange path P2 so as to divide the space within the header tank 4 into two compartments 4*a* and 4*b* arranged in the vertical direction. Similarly, the header tank 5 has a partition member 9 which is formed of aluminum and is provided at a vertical position between the first heat exchange path P1 and the second heat exchange path P2 so as to divide the space within the header tank 5 into two compartments 5*a* and 5*b* arranged in the vertical direction. A portion of the condenser 1 located on the lower side of the two partition members 8 and 9 is the condensation section 1A, and a portion of the condenser 1 located on the upper side of the two partition members 8 and 9 is the super-cooling section 1B.

The compartment 4*a* of the right header tank 4 located below the partition member 8 serves as a condensation section inlet header section 11 which communicates with upstream (with respect to the refrigerant flow direction) end portions of the heat exchange tubes 3 of the first heat exchange path P1. Similarly, the compartment 4*b* of the right header tank 4 located above the partition member 8 serves as a super-cooling section outlet header section 12 which communicates with downstream (with respect to the refrigerant flow direction) end portions of the heat exchange tubes 3 of the second heat exchange path P2. The compartment 5*a* of the left header tank 5 located below the partition member 9 serves as a condensation section outlet header section 13 which communicates with downstream (with respect to the refrigerant flow direction) end portions of the heat exchange tubes 3 of the first heat exchange path P1. Similarly, the compartment 5*b* of the left header tank 5 located above the partition member 9 serves as a super-cooling section inlet header section 14 which communicates with upstream (with respect to the refrigerant flow direction) end portions of the heat exchange tubes 3 of the second heat exchange path P2.

A refrigerant inlet 15 is formed in the condensation section inlet header section 11 of the right header tank 4 at an intermediate position in the vertical direction, and a refrigerant inlet member 16 formed of aluminum and having a passage communicating with the refrigerant inlet 15 is joined to the right header tank 4. A refrigerant outlet 17 is formed in the super-cooling section outlet header section 12 of the right header tank 4, and a refrigerant outlet member 18 formed of aluminum and having a passage communicating with the refrigerant outlet 17 is joined to the right header tank 4. A header-section-side refrigerant outlet 19 is formed in the condensation section outlet header section 13 of the left header tank 5 at a position near the lower end of the condensation section outlet header section 13. Similarly, a header-section-side refrigerant inlet 21 is formed in a lower portion of the super-cooling section inlet header section 14 of the left header tank 5.

As shown in FIGS. 3 and 4, the liquid receiver 2 includes a liquid receiver main body 22 and a circular columnar plug 25. The liquid receiver main body 22 is composed of a cylindrical tubular member 23 formed of aluminum, and a lower-end closing member 24 formed of aluminum and brazed to the lower end of the cylindrical tubular member 23 so as to close an opening of the cylindrical tubular member 23 at the lower end. The liquid receiver main body 22 is brazed to the left header tank 5. The circular columnar plug 25 is formed of synthetic resin and closes an opening of the liquid receiver main body 22 at the upper end. A liquid-receiver-side refrigerant inlet 26 which communicates with the header-section-side refrigerant outlet 19 is formed in the cylindrical tubular member 23 of the liquid receiver main body 22 at a position near the lower end. Similarly, a liquid-receiver-side refrigerant outlet 27 which communicates with the header-section-side refrigerant inlet 21 is formed in the cylindrical tubular member 23 at a vertical position above the partition member 9. An internal thread 23*a* is formed on an upper end portion of the inner circumferential surface of the cylindrical tubular member 23 of the liquid receiver main body 22. An external thread 25*a* formed on an upper portion of the outer circumferential surface of the plug 25 is brought into screw engagement with the internal thread 23*a* of the liquid receiver main body 22, whereby the plug 25 is removably attached to the upper end of the liquid receiver main body 22. Notably, for the purpose of sealing, an O-ring 28 is disposed between a portion of the inner circumferential surface of the cylindrical tubular member 23 of the liquid receiver main body 22, the portion being located below the internal thread 23*a*, and a portion of the outer circumferential surface of the plug 25, the portion being located below the external thread 25*a*.

The liquid receiver 2 includes a partition member 29 (partition portion) which is formed of synthetic resin and which divides the space within the liquid receiver 2 into two compartments 2*a* and 2*b* arranged in the vertical direction. The compartment 2*a* on the lower side serves as a first space 31 which communicates with the condensation section 1A through the liquid-receiver-side refrigerant inlet 26. The compartment 2*b* on the upper side serves as a second space 32 which is located above the first space 31, is separated from the first space 31, and communicates with the supercooling section 1B through the liquid-receiver-side refrigerant outlet 27.

A suction pipe 33 having a circular transverse cross section is disposed in the first space 31 within the liquid receiver 2. The suction pipe 33 is open at its upper and lower ends. An opening of the suction pipe 33 at the upper end thereof communicates with the second space 32, and an opening of the suction pipe 33 at the lower end thereof communicates with the first space 31. The suction pipe 33 establishes communication between the second space 32 and a region of the first space 31 near the lower end thereof. The suction pipe 33 is formed integrally with the partition member 29 such that the suction pipe 33 penetrates the partition member 29. The upper end of the suction pipe 33 projects into the second space 32, and the interior space of the suction pipe 33 communicates with the first space 31 and the second space 32. Notably, the suction pipe 33 may be formed separately from the partition member 29 and fixed to the partition member 29 such that the suction pipe 33 extends through the partition member 29 and its upper end projects into the second space 32.

A flow control member 34 is disposed in the first space 31 within the liquid receiver 2. The refrigerant flowing into the first space 31 through the refrigerant inlet 26 hits against the flow control member 34, whereby the flow direction of the refrigerant is changed. The flow control member 34 is a cylindrical member whose longitudinal direction coincides with the vertical direction and is open at at least one of the upper and lower ends thereof (in the present embodiment, the upper end is open and the lower end is closed). The flow control member 34 is disposed around the suction pipe 33 in such a manner that a gap is formed between the flow control member 34 and the cylindrical tubular member 23 of the liquid receiver 2 and a gap is formed between the flow control member 34 and the suction pipe 33. The refrigerant inlet 26 is located within the range of the flow control member 34 in the height direction thereof. The center line of the suction pipe 33 is aligned with the center line of the flow control member 34.

A foreign substance removal member 35 for removing foreign substances from the refrigerant is disposed in the first space 31 within the liquid receiver 2. The foreign substance removal member 35 is composed of a filter holding member 36 and a filter 37 which is held by the filter holding member 36 and removes foreign substances by filtration. The filter holding member 36 has a cylindrical main body 36*a*, a lower end closing wall 36*b*, and an outward flange 36*c*. The cylindrical main body 36*a* is disposed around the flow control member 34 with a gap formed between the cylindrical main body 36*a* and the flow control member 34. The cylindrical main body 36*a* has an upper end located above the upper end of the refrigerant inlet 26 and has a lower end located below the lower end of the refrigerant inlet 26. The lower end closing wall 36*b* closes the lower end of the cylindrical main body 36*a*. The outward flange 36*c* is provided at the upper end of the cylindrical main body 36*a* and its peripheral edge is in close contact with the inner surface of the circumferential wall of the liquid receiver 2. The filter holding member 35 is formed of synthetic resin, and the cylindrical main body 36*a*, the lower end closing wall 36*b*, and the outward flange 36*c* are integrally formed. The cylindrical main body 36*a* of the filter holding member 36 has a plurality of communication openings 38 which are formed at predetermined intervals in the circumferential direction so as to establish communication between the interior space and exterior space of the cylindrical main body 36*a*. The filter 37 is fixed to the cylindrical main body 36*a* such that the filter 37 covers the communication openings 38. The refrigerant inlet 26 is located within the vertical range and circumferential range of one of the communication openings 38. The lower end of the cylindrical flow control member 34 is integral with the lower end closing wall 36*b* of the filter holding member 36 of the foreign substance removal member 35, and an opening of the cylindrical flow control member 34 at the lower end thereof is closed by the lower end closing wall 36*b*. The flow control member 34 and the filter holding member 36 are integrally formed of synthetic resin.

The flow control member 34 is not necessarily required to be formed integrally with the filter holding member 36 of the foreign substance removal member 35. Also, the flow control member 34 may be a cylindrical member which is open at the upper and lower ends thereof so long as the refrigerant inlet 26 is located within the range of the flow control member 34 in the height direction.

Notably, although not illustrated, a desiccant container is disposed in the first space 31 within the liquid receiver 2.

The condenser 1 constitutes a refrigeration cycle in cooperation with a compressor, an expansion valve (pressure reducer), and an evaporator; and the refrigeration cycle is mounted on a vehicle as a car air conditioner.

In the condenser 1 having the above-described structure, gas-phase refrigerant of high temperature and high pressure compressed by the compressor flows into the condensation section inlet header section 11 of the right header tank 4 through the refrigerant inlet member 16 and the refrigerant inlet 15. The refrigerant is condensed, while flowing leftward within the heat exchange tubes 3 of the first heat exchange path P1, and flows into the condensation section outlet header section 13 of the left header tank 5. The gas-liquid mixed-phase refrigerant having flowed into the condensation section outlet header section 13 of the left header tank 5 enters the first space 31 within the liquid receiver 2 through the header-section-side refrigerant outlet 19 and the liquid-receiver-side refrigerant inlet 26.

The gas-liquid mixed-phase refrigerant having flowed into the first space 31 within the liquid receiver 2 passes through the filter 37 of the foreign substance removal member 35, whereby foreign substances are removed from the gas-liquid mixed-phase refrigerant. The gas-liquid mixed-phase refrigerant then hits against the outer surface of the circumferential wall of the flow control member 34. As a result of hitting against the outer surface of the circumferential wall of the flow control member 34, the gas-liquid mixed-phase refrigerant from which foreign substances have been removed is separated into gas-phase refrigerant and liquid-phase refrigerant. The gas-phase refrigerant flows upward and accumulates in an upper portion of the first space 31. The liquid-phase refrigerant flows over the upper end of the circumferential wall of the flow control member 34, enters the space inside the flow control member 34, and flows into the suction pipe 33 through the lower end opening thereof. The liquid-phase refrigerant having entered the suction pipe 33 flows into the second space 32 through the suction pipe 33, and enters the super-cooling section inlet header section 14 of the left header tank 5 through the liquid-receiver-side refrigerant outlet 27 and the header-section-side refrigerant inlet 21.

The refrigerant having entered the super-cooling section inlet header section 14 of the left header tank 5 is super-cooled, while flowing rightward within the heat exchange tubes 3 of the second heat exchange path P2. Subsequently, the super-cooled refrigerant enters the super-cooling section outlet header section 12 of the right header tank 4 and flows out through the refrigerant outlet 17 and the refrigerant outlet member 18. The refrigerant is then fed to the evaporator through the expansion valve.

Figure 5:
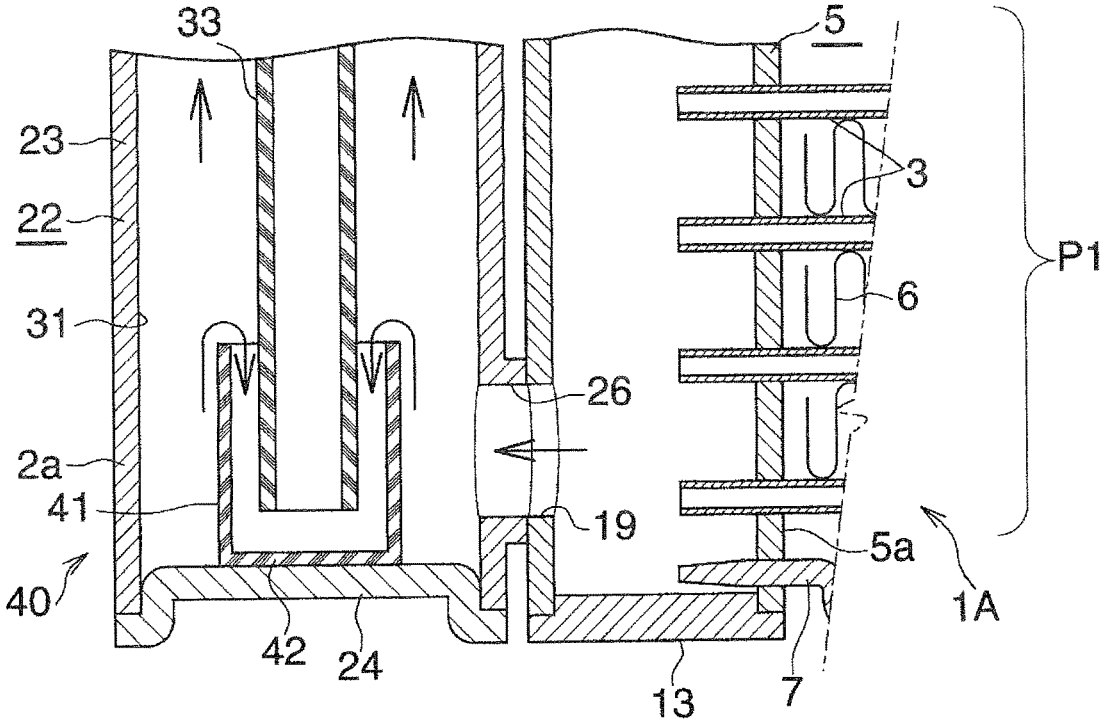
FIG. 5 is a view corresponding to a portion of FIG. 3 and showing a modification of the liquid receiver of the condenser of FIG. 1.
Figure 6:
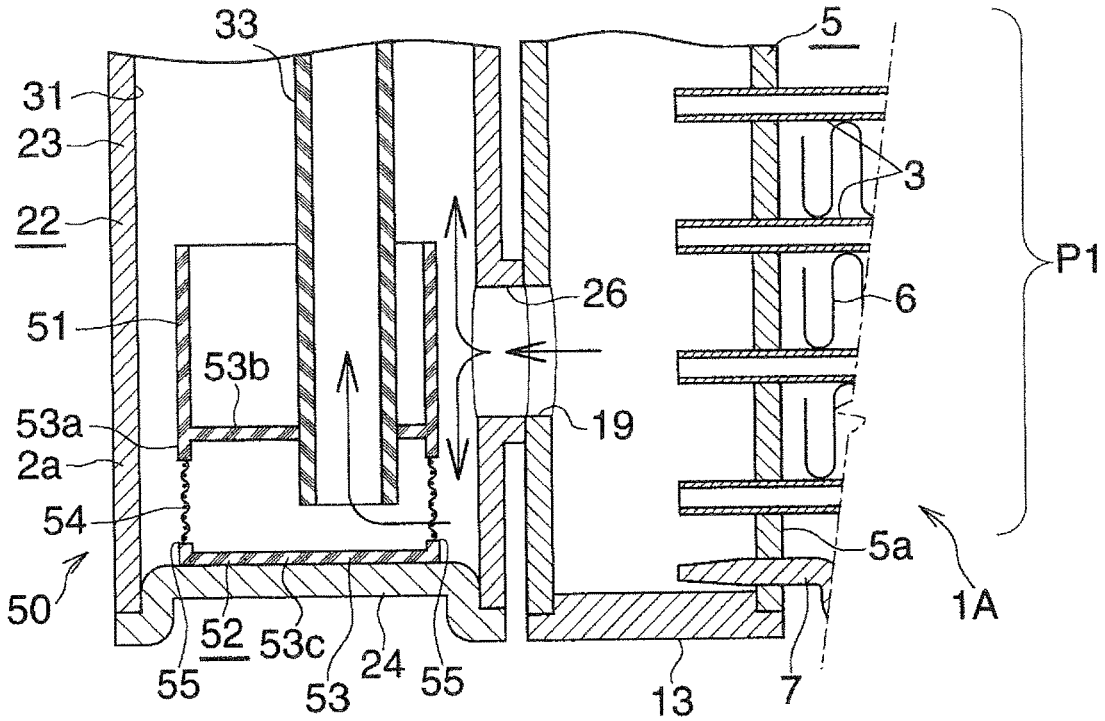
FIG. 6 is a view corresponding to a portion of FIG. 3 and showing another modification of the liquid receiver of the condenser of FIG. 1.

FIGS. 5 and 6 show modifications of the liquid receiver of the condenser 1 of FIG. 1.

In the case of a liquid receiver 40 shown in FIG. 5, a flow control member 41 is a cylindrical member whose upper end is open and whose lower end is closed by a lower end closing wall 42. Notably, the flow control member 41 may be a cylindrical member which is open at the upper and lower ends thereof so long as the refrigerant inlet 26 is located within the range of the flow control member 41 in the height direction. Also, a foreign substance removal member for removing foreign substances from the refrigerant is disposed in the liquid receiver 40 to be located at an unillustrated proper position.

The structure of the remaining portion of the liquid receiver 40 is the same as that of the liquid receiver 2.

In the case of a liquid receiver 50 shown in FIG. 6, a flow control member 51—which is disposed in the first space 31 of the liquid receiver 50 and against which the refrigerant flowing into the liquid receiver 50 through the refrigerant inlet 26 hits so that the refrigerant changes its flow direction—is a cylindrical member whose longitudinal direction coincides with the vertical direction. The flow control member 51 is disposed around the suction pipe 33 such that a gap is formed between the flow control member 51 and the cylindrical tubular member 23 of the liquid receiver 50 and a gap is formed between the flow control member 51 and the suction pipe 33. The refrigerant inlet 26 is located within the range of the flow control member 51 in the height direction. The center line of the suction pipe 33 is eccentric from the center line of the flow control member 51.

A foreign substance removal member 52 which is disposed in the first space 31 within the liquid receiver 50 and removes foreign substances from the refrigerant is composed of a filter holding member 53 and a filter 54 which is held by the filter holding member 53 and removes foreign substances by filtration. The filter holding member 53 includes a cylindrical main body 53*a* which is integrally formed at the lower end of the flow control member 51 and extends downward, and upper and lower end closing walls 53*b* and 53*c* which close the upper and lower ends of the cylindrical main body 53*a*. The cylindrical main body 53*a* of the filter holding member 53 has a plurality of communication openings 55 which are formed at predetermined intervals in the circumferential direction so as to establish communication between the interior space and exterior space of the cylindrical main body 53*a*. The filter 54 is fixed to the cylindrical main body 53*a* such that the filter 54 covers the communication openings 55. The upper end closing wall 53*b* of the filter holding member 53 is located below the refrigerant inlet 26.

The flow control member 51 is a cylindrical member whose upper end is open and whose lower end is closed by the upper end closing wall 53*b* of the filter holding member 53 of the foreign substance removal member 52. The suction pipe 33 extends through the upper end closing wall 53*b* of the filter holding member 53, so that the lower end of the suction pipe 33 is located within the cylindrical main body 53*a*. Therefore, communication is established between the interior space of the cylindrical main body 53*a* of the filter holding member 53 and the interior space of the suction pipe 33. The flow control member 51 and the filter holding member 53 are integrally formed of synthetic resin.

The structure of the remaining portion of the liquid receiver 50 is the same as that of the liquid receiver 2.

The present invention comprises the following modes.

1) A condenser comprising a condensation section, a super-cooling section provided above the condensation section, and a liquid receiver provided between the condensation section and the super-cooling section, each of the condensation section and the super-cooling section having at least one heat exchange path formed by a plurality of heat exchange tubes disposed parallel to one another such that their longitudinal direction coincides with a left-right direction and they are spaced from one another in a vertical direction, refrigerant flowing out of the condensation section flowing into the super-cooling section through the liquid receiver, the liquid receiver having a refrigerant inlet through which the refrigerant from the condensation section flows into the liquid receiver, and a refrigerant outlet which is located above the refrigerant inlet and through which the refrigerant flows out to the super-cooling section, the liquid receiver having a first space communicating with the condensation section through the refrigerant inlet, and a second space located above the first space, separated from the first space, and communicating with the super-cooling section through the refrigerant outlet, the condenser comprising a suction pipe which is disposed in the first space of the liquid receive and is open at upper and lower ends thereof, whose opening at the upper end communicates with the second space, and whose opening at the lower end communicates with the first space, wherein the condenser further comprises a flow control member which is disposed in the first space of the liquid receiver and against which the refrigerant having flowed into the first space through the refrigerant inlet hits so that the refrigerant changes its flow direction, and wherein a lower end of the suction pipe is disposed below an upper end of the flow control member.

2) The condenser described in par. 1), wherein the flow control member is a tubular member which is open at least one of upper and lower ends thereof;

the flow control member is disposed around the suction pipe such that a gap is formed between the flow control member and a circumferential wall of the liquid receiver and a gap is formed between the flow control member and the suction pipe; and the refrigerant inlet is located within a range of the flow control member in a height direction thereof.

3) The condenser described in par. 2), wherein a center line of the suction pipe is aligned with a center line of the flow control member.

4) The condenser described in par. 2), wherein a center line of the suction pipe is eccentric from a center line of the flow control member.

5) The condenser described in any of pars. 2) to 4), further comprising a foreign substance removal member disposed in the first space of the liquid receiver and removing foreign substances from the refrigerant, wherein the foreign substance removal member is composed of a filter holding member and a filter which is held by the filter holding member and removes the foreign substances by filtration;

the filter holding member includes a tubular main body which is disposed around the flow control member with a gap formed between the tubular main body and the flow control member, whose upper end is located above an upper end of the refrigerant inlet, and whose lower end is located below a lower end of the refrigerant inlet, a lower end closing wall which closes the lower end of the tubular main body, and an outward flange which is provided at the upper end of the tubular main body and whose peripheral edge is in close contact with an inner surface of the circumferential wall of the liquid receiver;

a plurality of communication openings are formed in the tubular main body of the filter holding member; and the filter is fixed to the tubular main body in such a manner that the filter covers the communication openings.

6) The condenser described in par. 5), wherein the tubular main body of the filter holding member of the foreign substance removal member is formed integrally with the flow control member; and the flow control member is a tubular member whose upper end is open and whose lower end is closed by the lower end closing wall of the filter holding member of the foreign substance removal member.

7) The condenser described in any of pars. 2) to 4), further comprising a foreign substance removal member disposed in the first space of the liquid receiver and removing foreign substances from the refrigerant, wherein the foreign substance removal member is composed of a filter holding member and a filter which is held by the filter holding member and removes the foreign substances by filtration;

the filter holding member includes a tubular main body integrally formed at the lower end of the flow control member and extending downward, and upper and lower end closing walls for closing upper and lower ends of the tubular main body;

a plurality of communication openings are formed in the tubular main body of the filter holding member;

the filter is fixed to the tubular main body in such a manner that the filter covers the communication openings;

the flow control member is a tubular member whose upper end is open and whose lower end is closed by the upper end closing wall of the filter holding member of the foreign substance removal member; and the suction pipe extends through the upper end closing wall of the filter holding member of the foreign substance removal member such that the lower end of the suction pipe is located within the tubular main body, whereby communication is established between an interior space of the tubular main body of the filter holding member and an interior space of the suction pipe.

In the condenser of any of pars. 1) to 7), the liquid receiver has a refrigerant inlet through which the refrigerant from the condensation section flows into the liquid receiver, and a refrigerant outlet which is located above the refrigerant inlet and through which the refrigerant flows out to the super-cooling section; the liquid receiver has a first space communicating with the condensation section through the refrigerant inlet, and a second space located above the first space, separated from the first space, and communicating with the super-cooling section through the refrigerant outlet; and a suction pipe which is open at upper and lower ends thereof, whose opening at the upper end communicates with the second space, and whose opening at the lower end communicates with the first space is disposed in the first space of the liquid receive. The condenser further comprises a flow control member which is disposed in the first space of the liquid receiver and against which the refrigerant having flowed into the first space through the refrigerant inlet hits so that the refrigerant changes its flow direction, wherein a lower end of the suction pipe is disposed below an upper end of the flow control member. Therefore, the gas-liquid mixed-phase refrigerant having flowed from the condensation section into the first space of the liquid receiver through the refrigerant inlet hits against the outer surface of the circumferential wall of the flow control member and is separated into gas-phase refrigerant and liquid-phase refrigerant. The gas-phase refrigerant accumulates in an upper portion of the first space. The liquid-phase refrigerant enters the suction pipe through the lower end opening thereof, flows upward within the suction pipe, and flows into the second space. Subsequently, the liquid-phase refrigerant enters the super-cooling section through the refrigerant outlet. Accordingly, the performance of gas-liquid separation in the first space of the liquid receiver can be enhanced.

Also, since the performance of gas-liquid separation in the first space of the liquid receiver can be enhanced, the height position of the refrigerant inlet can be rendered closer to the lower end of the final heat exchange path of the condensation section. Therefore, the amount of refrigerant which liquefies in heat exchange tubes of the condensation section heat exchange path which are located below the refrigerant inlet decreases. As a result, as compared with the case where the height position of the refrigerant inlet is rendered closer to the lower end of the final heat exchange path of the condensation section in the condenser disclosed in the publication, the amount of the liquid-phase refrigerant stagnating in the condensation section decreases. Therefore, most of the condensation section can be efficiently used for heat exchange, and deterioration in condensation efficiency can be prevented. In addition, since the amount of the liquid-phase refrigerant stagnating in the condensation section decreases, the amount of compressor oil mixing into the liquid-phase refrigerant decreases, and the compressor oil circulates efficiently.

In the condenser of par. 2), the gas-liquid mixed-phase refrigerant having flowed from the condensation section into the first space of the liquid receiver through the refrigerant inlet hits against the outer surface of the circumferential wall of the flow control member without fail and is separated into gas-phase refrigerant and liquid-phase refrigerant. Therefore, the performance of gas-liquid separation in the first space of the liquid receiver can be enhanced effectively.

In the condenser of par. 3), the gap between the flow control member and the suction pipe is uniform over the entire circumference. As a result, it is possible to prevent biased flow of the refrigerant having flowed into the first space of the liquid receiver through the refrigerant inlet, which biased flow would otherwise occur until the refrigerant enters the suction pipe.

In the condenser of par. 5), the foreign substance removal member is composed of a filter holding member and a filter which is held by the filter holding member and removes the foreign substances by filtration; the filter holding member includes a tubular main body which is disposed around the flow control member with a gap formed between the tubular main body and the flow control member, whose upper end is located above an upper end of the refrigerant inlet, and whose lower end is located below a lower end of the refrigerant inlet, a lower end closing wall which closes the lower end of the tubular main body, and an outward flange which is provided at the upper end of the tubular main body and whose peripheral edge is in close contact with an inner surface of the circumferential wall of the liquid receiver; a plurality of communication openings are formed in the tubular main body of the filter holding member; and the filter is fixed to the tubular main body in such a manner that the filter covers the communication openings. Therefore, the gas-liquid mixed-phase refrigerant having flowed from the condensation section into the first space of the liquid receiver through the refrigerant inlet hits against the outer surface of the circumferential wall of the flow control member after passing through the filter of the foreign substance removal member without fail for removal of foreign substances. In addition, a filter area required for removal of foreign substances from the refrigerant can be secured sufficiently. Accordingly, it is possible to reliably remove foreign substances from the refrigerant through use of the filter of the foreign substance removal member and prevent the foreign substances from entering the suction pipe.

In the condenser of par. 6), the tubular main body of the filter holding member of the foreign substance removal member is formed integrally with the flow control member. Therefore, the number of components can be reduced.

In the condenser of par. 7), the foreign substance removal member is composed of a filter holding member and a filter which is held by the filter holding member and removes the foreign substances by filtration; the filter holding member includes a tubular main body integrally formed at the lower end of the flow control member and extending downward, and upper and lower end closing walls for closing upper and lower ends of the tubular main body; a plurality of communication openings are formed in the tubular main body of the filter holding member; and the filter is fixed to the tubular main body in such a manner that the filter covers the communication openings. Therefore, the gas-liquid mixed-phase refrigerant having flowed from the condensation section into the first space of the liquid receiver through the refrigerant inlet hits against the outer surface of the circumferential wall of the flow control member, and subsequently, liquid-phase refrigerant passes through the filter of the foreign substance removal member without fail. In addition, a filter area required for removal of foreign substances from the refrigerant can be secured sufficiently. Accordingly, it is possible to reliably remove foreign substances from the refrigerant through use of the filter of the foreign substance removal member and prevent the foreign substances from entering the suction pipe. In addition, since the tubular main body of the filter holding member of the foreign substance removal member is formed integrally with the flow control member, the number of components can be reduced.

What is claimed is:

1. A condenser comprising a condensation section, a super-cooling section provided above the condensation section, and a liquid receiver provided between the condensation section and the super-cooling section, each of the condensation section and the super-cooling section having at least one heat exchange path formed by a plurality of heat exchange tubes disposed parallel to one another such that their longitudinal direction coincides with a left-right direction and they are spaced from one another in a vertical direction, refrigerant flowing out of the condensation section flowing into the super-cooling section through the liquid receiver, the liquid receiver having a refrigerant inlet through which the refrigerant from the condensation section flows into the liquid receiver, and a refrigerant outlet which is located above the refrigerant inlet and through which the refrigerant flows out to the super-cooling section, the liquid receiver having a first space communicating with the condensation section through the refrigerant inlet, and a second space located above the first space, separated from the first space, and communicating with the super-cooling section through the refrigerant outlet, the condenser comprising a suction pipe which is disposed in the first space of the liquid receiver and is open at upper and lower ends thereof, whose opening at the upper end communicates with the second space, and whose opening at the lower end communicates with the first space, wherein the condenser further comprises a flow control member which is disposed in the first space of the liquid receiver and against which the refrigerant having flowed into the first space through the refrigerant inlet hits so that the refrigerant changes its flow direction, wherein a lower end of the suction pipe is disposed below an upper end of the flow control member;

wherein the flow control member is a tubular member which is open at least one of upper and lower ends thereof;

the flow control member is disposed around the suction pipe such that a gap is formed between the flow control member and a circumferential wall of the liquid receiver and a gap is formed between the flow control member and the suction pipe; and the refrigerant inlet is located within a range of the flow control member in a height direction thereof.

2. The condenser according to claim 1, wherein a center line of the suction pipe is aligned with a center line of the flow control member.

3. The condenser according to claim 1, wherein a center line of the suction pipe is eccentric from a center line of the flow control member.

4. The condenser according to claim 1, further comprising a foreign substance removal member disposed in the first space of the liquid receiver and removing foreign substances from the refrigerant, wherein the foreign substance removal member is composed of a filter holding member and a filter which is held by the filter holding member and removes the foreign substances by filtration;

the filter holding member includes a tubular main body which is disposed around the flow control member with a gap formed between the tubular main body and the flow control member, whose upper end is located above an upper end of the refrigerant inlet, and whose lower end is located below a lower end of the refrigerant inlet, a lower end closing wall which closes the lower end of the tubular main body, and an outward flange which is provided at the upper end of the tubular main body and whose peripheral edge is in close contact with an inner surface of the circumferential wall of the liquid receiver;

a plurality of communication openings are formed in the tubular main body of the filter holding member; and the filter is fixed to the tubular main body in such a manner that the filter covers the communication openings.

5. The condenser according to claim 4, wherein the tubular main body of the filter holding member of the foreign substance removal member is formed integrally with the flow control member; and the flow control member is a tubular member whose upper end is open and whose lower end is closed by the lower end closing wall of the filter holding member of the foreign substance removal member.

6. The condenser according to claim 1, further comprising a foreign substance removal member disposed in the first space of the liquid receiver and removing foreign substances from the refrigerant, wherein the foreign substance removal member is composed of a filter holding member and a filter which is held by the filter holding member and removes the foreign substances by filtration;

the filter holding member includes a tubular main body integrally formed at the lower end of the flow control member and extending downward, and upper and lower end closing walls for closing upper and lower ends of the tubular main body;

a plurality of communication openings are formed in the tubular main body of the filter holding member;

the filter is fixed to the tubular main body in such a manner that the filter covers the communication openings;

the flow control member is a tubular member whose upper end is open and whose lower end is closed by the upper end closing wall of the filter holding member of the foreign substance removal member; and the suction pipe extends through the upper end closing wall of the filter holding member of the foreign substance removal member such that the lower end of the suction pipe is located within the tubular main body, whereby communication is established between an interior space of the tubular main body of the filter holding member and an interior space of the suction pipe.

* * * * *